United States Patent [19]

Reaugh

[11] 4,284,153

[45] Aug. 18, 1981

[54] HYDRAULIC DRILL STRING JAR

[75] Inventor: Luther G. Reaugh, Edmonton, Canada

[73] Assignee: OPI Ltd., Alberta, Canada

[21] Appl. No.: 120,354

[22] Filed: Feb. 11, 1980

[30] Foreign Application Priority Data

Feb. 20, 1979 [CA] Canada ..... 321882

[51] Int. Cl.[3] ..... E21B 31/113

[52] U.S. Cl. ..... 175/297; 251/333

[58] Field of Search ..... 175/297, 296; 251/333

[56] References Cited

U.S. PATENT DOCUMENTS

| | | | |
|---|---|---|---|
| 2,902,250 | 9/1959 | Bering | 251/333 X |
| 3,088,533 | 5/1963 | Sutlith | 175/297 |
| 3,150,605 | 2/1963 | Howe | 251/333 X |
| 3,804,185 | 4/1974 | Mason | 175/297 |
| 4,181,186 | 1/1980 | Blanton | 175/297 |

*Primary Examiner*—William F. Pate, III

*Attorney, Agent, or Firm*—Cushman, Darby & Cushman

[57] ABSTRACT

The present invention accordingly relates to hydraulic jars which include elongated telescopically arranged mandrel and housing members relatively movable between contracted and extended positions such members respectively having a hammer and an anvil with the anvil being spaced from the hammer when the members are in the contracted position and arranged for contract when the members are in the extended position. The jar includes hydraulic means for retarding movement of the mandrel relative to the housing member for a given time during a jarring stroke when the jar is tensioned. The hydraulic means includes a fluid-filled chamber having adjoining first and second bores, the first bore being of lesser diameter than the second bore and a piston on the mandrel member being receivable in the first bore with the piston having a slightly smaller diameter than the first bore to restrict the flow of fluid past the piston as it moves relative to the first bore during the jarring stroke. When the piston exits from the first bore, the members move rapidly to the extended position so that the hammer delivers a blow to the anvil. The piston is of annular form and is positioned around the mandrel member for movement therealong between first and second axially spaced stops on the mandrel member. The piston has a first end adapted to co-operate with the first stop to permit free-flow of the fluid between the piston and mandrel member as the members move toward the contracted position. The piston also has a further portion adapted to co-operate with the second stop to provide sealing engagement therewith during movement of the piston through the first bore during the jarring stroke.

8 Claims, 6 Drawing Figures

HYDRAULIC DRILL STRING JAR

BACKGROUND OF THE INVENTION

The present invention relates in general to well drilling equipment and particularly to hydraulic jars for releasing drill strings or tools trapped in well bores.

As is well known in the art, during the drilling of a well, the drill pipe or well tools sometimes become lodged or stuck in the well bore. To assist in the recovery of a stuck tool, a hydraulic jar is commonly included in the drill string. As is well known in the art, hydraulic jars operate on the principle of a hydraulically delayed longitudinally moving hammer operatively coupled to the drill pipe, the hammer being released after a time delay to strike an anvil operatively attached to the parts stuck in the well bore. To provide the longitudinal movement and the resulting impact forces, tension is applied to the drill string via the usual hoisting equipment. The initial relative longitudinal movement in the jar is retarded by a hydraulic mechanism to permit the desired tension to be applied.

A typical hydraulic mechanism for providing the time delay in the jar comprises a piston moving in a bore to compress a hydraulic fluid in a chamber, the delayed rate of movement of the piston being controlled either by a fluid metering orifice bypassing the piston or alternatively by sizing the piston relative to the bore so that the fluid leaks therebetween at a selected rate. The jar is provided with a release bore of larger diameter than the compression bore to provide a relatively large fluid bypass and sudden release of the piston in the chamber. The compression of the hydraulic fluid produces large magnitude forces within the jar. The tension which can be applied to the jar is often limited by the capability of the jar notwithstanding the hydraulic forces produced therein. These forces sometimes develop a pressure of well in excess of 40,000 lbs. per square inch.

While metering orifices bypassing the piston as described above are well known and quite widely accepted, there is the danger of the metering orifice becoming partially or fully blocked by foreign matter during the course of operation thus impairing or disabling the jar. When a well tool is so stuck in the well bore that tension alone will not release it it is vital that a jar, if used, be in perfect working order. A jar that has failed is of utterly no use and it is probable that the stuck tool will be lost if the drilling string breaks under tension.

The present invention is concerned with the second variety of hydraulic jar referred to above, i.e. one wherein the necessary time delay is provided by sizing the piston relative to the compression bore so that the fluid leaks therebetween at a selected rate during the jarring stroke.

In order to provide for uniformity and consistency in the time delay in a jar of this nature it is of course well known that the outside diameter of the piston must be carefully selected in relation to the inside diameter of the compression bore of the jar. The effect on the time delay of wear on these surfaces and of any changes in surface shape which may occur in the piston as a result of the pressures encountered during use are quite well known and have been dealt with elsewhere. However, there is another vital area of concern and this comprises the surfaces of the inner mandrel and the piston which must come into sealing engagement with one another to prevent bypass of hydraulic fluid therebetween during the jarring stroke. It has been found that unless these surfaces are extremely accurately machined that some leakage therebetween will occur thus making it difficult to maintain a uniform release time from one jar to the next. In addition, during normal use, a certain amount of wear of the contacting surfaces occurs which, particularly when coupled with the presence of any foreign materials in the hydraulic fluid, causes wear and degeneration of the mating surfaces such that the time delay period will vary during normal usage.

SUMMARY OF THE INVENTION

It is accordingly a principal object of the present invention to provide improvements in hydraulic jars which are capable of alleviating the problem referred to above.

The present invention accordingly relates to hydraulic jars which include elongated telescopically arranged mandrel and housing members relatively movable between contracted and extended positions such members respectively having a hammer and an anvil with the anvil being spaced from the hammer when the members are in the contracted position and arranged for contract when the members are in the extended position. The jar includes hydraulic means for retarding movement of the mandrel relative to the housing member for a given time during a jarring stroke when the jar is tensioned. The hydraulic means includes a fluid-filled chamber having adjoining first and second bores, the first bore being of lesser diameter than the second bore and a piston on the mandrel member being receivable in the first bore with the piston having a slightly smaller diameter than the first bore to restrict the flow of fluid past the piston as it moves relative to the first bore during the jarring stroke. When the piston exits from the first bore, the members move rapidly to the extended position so that the hammer delivers a blow to the anvil. The piston is of annular form and is positioned around the mandrel member for movement therealong between first and second axially spaced stops on the mandrel member. The piston has a first end adapted to co-operate with the first stop to permit free-flow of the fluid between the piston and mandrel member as the members move toward the contracted position. The piston also has a further portion adapted to co-operate with the second stop to provide sealing engagement therewith during movement of the piston through the first bore during the jarring stroke.

In accordance with a principal feature of the invention, one of said further portion and said second stop includes a smooth annular wall portion which is sloped relative to the longitudinal axis of the jar while the other includes a smooth annular surface having a convexly arcuate contour as seen in a longitudinal section, with said sloped annular wall portion and said annular convexly arcuate surface being relatively disposed to come into said sealing engagement during the jarring stroke.

As a further feature of the invention, said further portion of said piston is located interiorly of the annular piston intermediate said first end and the opposite end thereof. Preferably, said further portion of the piston is located nearer to said first end than it is to the opposite end of the piston.

In the preferred form of the invention, the sloped wall portion comprises a frustro-conical wall portion, the latter being located on the annular piston while the annular convexly arcuate surface is located on the mandrel member. In a preferred embodiment of the invention the convexly arcuate surface has a semi-circular outline as seen in longitudinal section.

In a typical embodiment of the invention, the mandrel member has a splined connection with the housing member thus permitting non-rotative relative movement between the extended and contracted positions.

It has been found that hydraulic jars constructed in accordance with the principles of the present invention can exhibit substantially longer service lives than otherwise conventional designs with there being less change in the average release time over this service. At the same time, there is less variation in the release time from one hydraulic jar to the next assuming that they all have been produced utilizing the same manufacturing techniques and with the same machining and manufacturing tolerances.

BRIEF DESCRIPTION OF THE DRAWINGS

A preferred embodiment of the invention will now be described with reference being had to the accompanying drawings in which.

DETAILED DESCRIPTION OF THE PREFERRED EMBODIMENT

Figure 1:
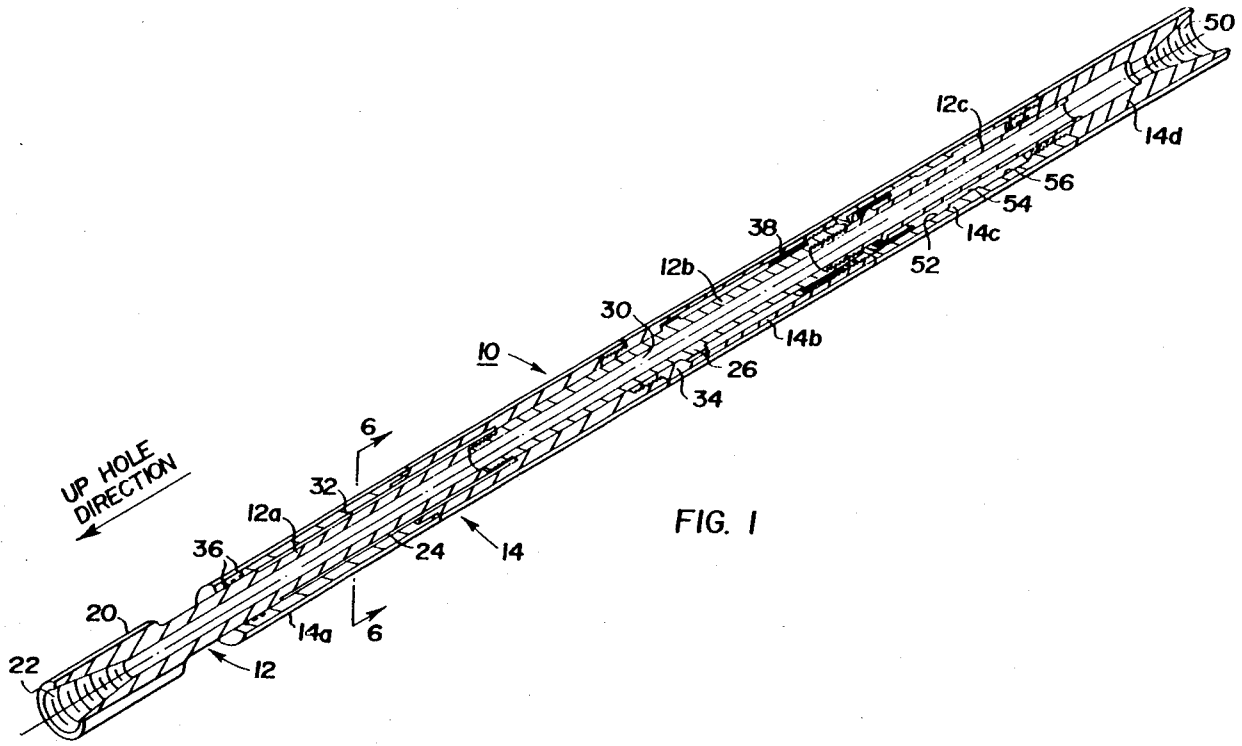
FIG. 1 is a perspective view in longitudinal section of a hydraulic jar incorporating the principles of the present invention.

With reference firstly to FIG. 1, reference numeral 10 designates the hydraulic jar, the latter, in turn, being constructed from two basic sub-assemblies namely a mandrel 12 and an outer housing 14. The mandrel 12 is telescopingly arranged within housing 14 and is relatively movable with respect to the latter along the longitudinal axis of the jar between contracted and extended positions.

The mandrel 12 is comprised of three main sections, namely an upper section 12*a*, an intermediate section 12*b*, and a lower section 12*c*. These three sections are secured together by mutually engaging male and female screw thread portions which provide for ease of assembly and disassembly. The upper section of the mandrel 12 is provided with a connector head 20 provided with a tapered internal thread 22 to provide for connection to an external thread on the pin end of a drill string. Thus, when placed in a drill hole, the connector head 20 would be the uppermost component of the hydraulic jar 10.

The upper section 12*a* of the mandrel is also provided with a plurality of longitudinally directed splines 24 spaced around the circumference of same, the use of which will be discussed later. The intermediate mandrel section 12*b* is provided with an annular hammer 26 which will be discussed in further detail later on while the lower mandrel section 12*c* passes through, among other things, a hydraulic chamber provided adjacent the lower end of housing 14. The entire mandrel 12 includes a central longitudinally extending bore 30 extending therethrough for passage therealong of drilling fluid for purposes well known in the art.

Figure 6:
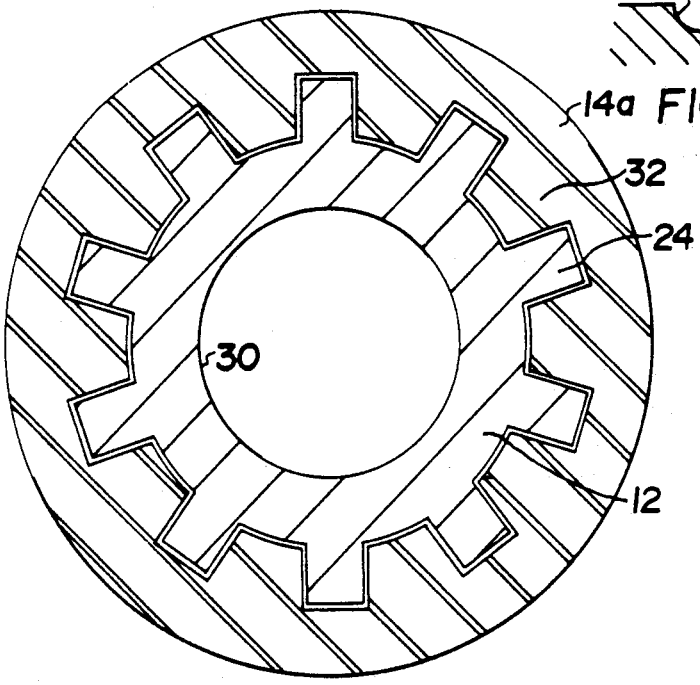
FIG. 6 is a section view taken along line 6—6 of FIG. 1 and illustrating the splined connection between the mandrel and housing.

The housing 14 is also comprised of a plurality of sections 14*a*, 14*b*, 14*c*, and 14*d*. The uppermost housing section 14*a* includes a plurality of splines 32 which interengage with splines 24 on the mandrel thereby permitting only non-rotative relative movement of the mandrel 12 relative to the housing 14 between extended and contracted positions. The interengaging splines of the housing and mandrel are shown in further detail in the cross-section view of FIG. 6.

The next section of the housing, i.e. 14*b*, may be referred to as the anvil section in that it includes an annular step 34 formed in the inner wall of same, which step is adapted to cooperate with the annular hammer 26 formed on the adjacent mandrel section. When the mandrel 12 moves relative to housing 14 from the contracted position to the extended position, the hammer 26 is capable of delivering a heavy blow to anvil 34 for purposes of providing the desired jarring force.

In order to prevent entry of contaminants into the interior of the jar, the upper end of housing 14 is provided with suitable sealing elements 36 provided in a series of annular grooves provided in the inner wall of the housing. The seals may be of any suitable variety capable of withstanding the high fluid pressures involved, e.g. the well known "Parker" seals. In order to further guard against entry of contaminants into the housing 14, and particularly to guard against entry of such contaminants into the regions between the interengaging splines 24 and 32 of the mandrel and housing, the intermediate mandrel section 12*b* is provided with an annular compensating piston 38 (best seen in FIG. 2) which sealingly engages with both the interior wall of the housing and the exterior wall of the mandrel. This compensating piston is provided with both external and interior annular grooves which serve to retain therein suitable sealing rings 40 and 42. The housing 12 is provided adjacent the lower end of its intermediate section 12*b* with a plurality of radially directed ports 46 which allow fluids in the well bore to enter into the casing behind the compensating piston 38. Thus, as mandrel 12 is extended relative to housing 14, the compensating piston moves along the interior of housing 14 with drilling fluids entering via the ports 46. Thus the interior pressure is balanced with the exterior pressure at all times thus helping to ensure that the lubricants used to prevent wear of interengaging splines 24 and 32 are not contaminated by foreign material such as well bore cuttings.

Section 14*c* of the housing may be referred to as the hydraulic section since it is in this portion of the housing that the hydraulic means are provided which serve to retard the movement of the mandrel 12 relative to the housing 14 for a given time between a contracted and extended position during a jarring stroke when the jar is tensioned. Connected to section 14*c* of the housing is the lowermost section 14*d* which is the connector section in that it includes internal tapered threads 50 adapted for connection to the threaded pin portion of a tool, such as a drill bit.

The housing section 14*c* is provided with three adjoining bores 52, 54 and 56. Bore 54 is of lesser diameter than bores 52 and 56. The entire chamber in which the three bores 52, 54 and 56 are located is filled with a working fluid such as a silicone-based fluid which exhibits small viscosity changes over a wide temperature range.

An annular piston 60 is mounted on mandrel section 12*c* and is axially movable relative thereto between first and second stops 62 and 64 provided on adjoining mandrel sections 12*b* and 12*c* respectively. The annular piston 60 has an outside diameter which is just slightly smaller than the diameter of bore 54 thereby to restrict the flow of the working fluid past the piston 60 as it is moved through the first bore 54 during a jarring stroke until piston 60 exits from bore 54 and enters into the larger bore 52 whereupon the mandrel and housing move rapidly to the relatively extended position thus causing hammer 26 to deliver a heavy blow to anvil 34. This overall action need not be described in great detail since it is generally well known in the art.

Figure 4:
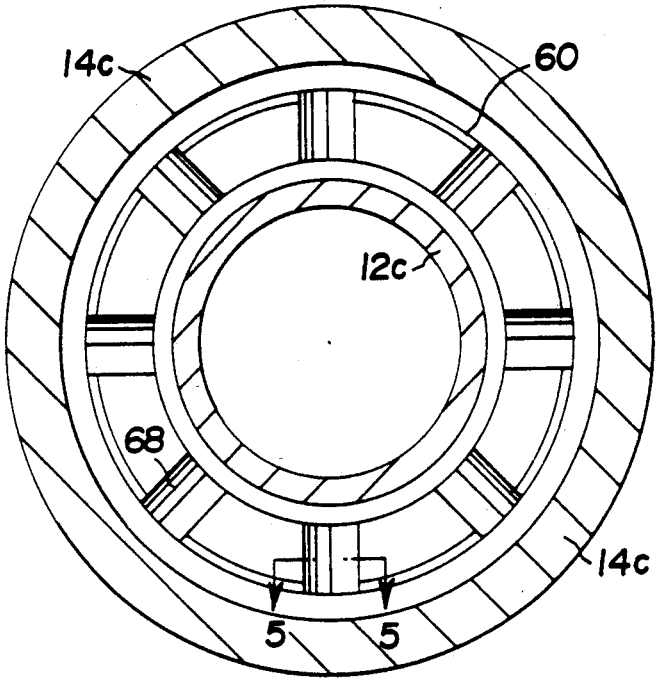
FIG. 4 is a section view of the hydraulic jar taken along line 4—4 of FIG. 2 and looking toward the upper end of the annular piston.
Figure 5:
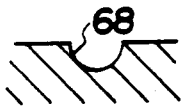
FIG. 5 is a partial section view taken along line 5—5 of FIG. 4.

During the return stroke it is desired that there be free flow of the working fluid between the piston 60 and the mandrel 12 as the mandrel is moved toward the contracted position relative to the housing. In order to achieve this, the upper end portion 66 of piston 60 is provided with a plurality of radially directed grooves 68 as best seen in FIG. 4, such grooves 68 preferably being of semi-circular cross-section as best seen in FIG. 5. Thus, during movement toward the contracted position, the stop 62 buts against end portion 66 of piston 60 with the working fluid passing between the mandrel 12 and piston 60 via the radially directed grooves 68; this is particularly the case when the piston 60 is moving through the reduced diameter bore 54. The other relatively enlarged diameter bore 56 need not be described here in detail; it being sufficient to state that the opposite of a jarring action may be effected by virtue of the structure shown, i.e. a bumping action may be effected as the housing and mandrel are moved toward the relatively contracted position. The annular piston 60 also rests in this second enlarged diameter bore 56 when the mandrel and housing are in the relatively contracted position, i.e. prior to commencement of a jarring stroke.

Figure 2:
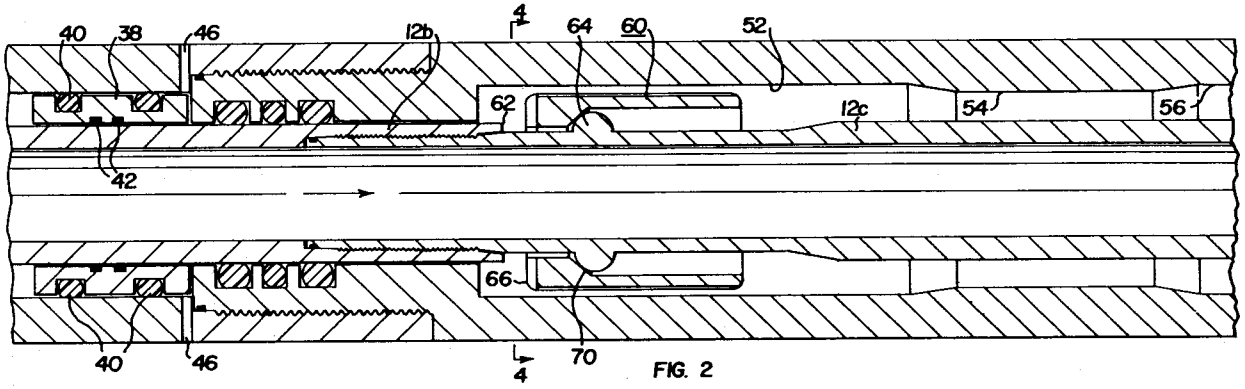
FIG. 2 is a longitudinal section view of a portion of the hydraulic jar illustrating a portion of the hydraulic means for retarding the movement of the mandrel relative to the housing.
Figure 3:
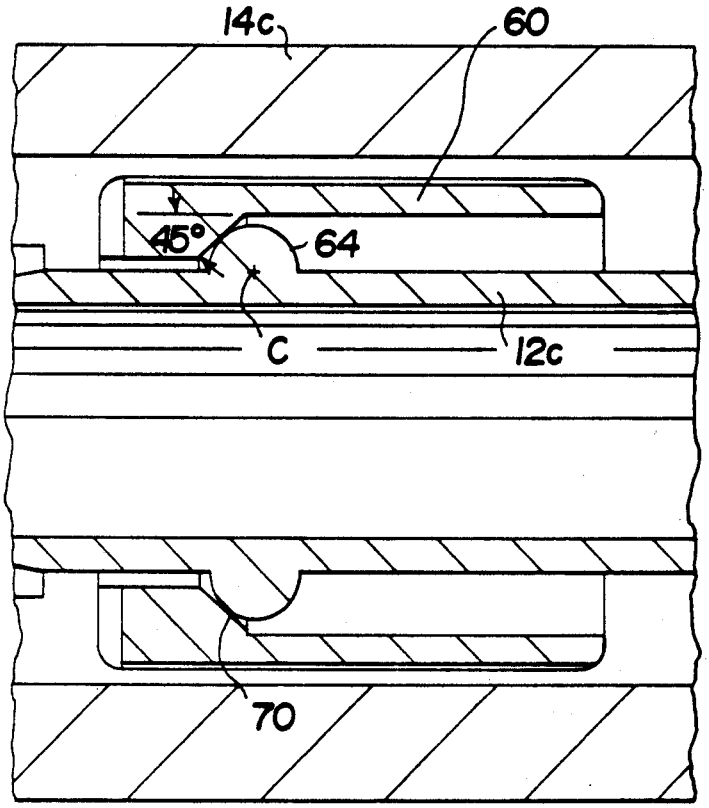
FIG. 3 is an enlargement of the annular piston and the mandrel portion which co-operates therewith.

As best seen in FIGS. 2 and 3, the annular piston 60 has a portion 70 which is shaped to co-operate with the second stop 64 on the mandrel to provide sealing engagement therewith during movement of the piston through bore 54 during a jarring stroke. As shown in the drawings, this portion 70 of the piston is in the form of a smooth annular wall portion which is sloped relative to the longitudinal axis of the jar. As shown in the drawings, in the preferred form of the invention, this sloped wall portion comprises a frusto-conical wall portion and it is preferably disposed at about a 45° angle to the jar axis although this angle is not particularly critical. The stop 64 on the mandrel is in the form of a smooth surfaced annular member having a convexly arcuate contour as seen in a longitudinal section. In the preferred form of the invention the convexly arcuate surface has a semi-circular outline centered at point C as best seen for example in FIG. 3. Both of the above described surfaces are machined to a smooth surface and preferably they are provided with a hard chrome surface to improve their wearing capabilities.

During the jarring stroke, the high pressures inserted on annular piston 60 by the working fluid cause the convexly arcuate annular surface of stop 64 to come into close sealing engagement with the sloping annular wall portion 70. A "wedging" effect is achieved and it has been found that by virtue of this combination that a good sealing effect can be achieved over a very long period of use as compared with prior art devices thus effecting a great saving in overall maintenance costs and down-time. The sealing capabilities of the abovedescribed surfaces are not adversely affected even after a reasonable amount of wear has taken place. The overall result is that the fundamental characteristics of the hydraulic jar do not deteriorate as rapidly during use as is the case with comparable prior art devices. Furthermore it has been found easier to achieve substantially uniform characteristics from one hydraulic jar to the next when manufactured in accordance with or using basically the same tolerances.

The overall mode of operation of the hydraulic jar described above will be readily apparent to the person skilled in the art as will also be its manner of use as a jarring and bumping tool. Hence, no further description of these operations need be provided.

It will be understood that the invention is not to be limited to the specific embodiment described above by way of example but that the invention may be provided in various ways and within the scope of the appended claims.

I claim:

1. A hydraulic jar for use in a drill string including elongated telescopically-arranged mandrel and housing members relatively movable along the longitudinal axis of the jar between contracted and extended positions, said members respectively having a hammer and an anvil, said anvil being spaced from said hammer when said members are in a contracted position and arranged for contact when said members are in an extended position, hydraulic means in said jar for retarding movement of said mandrel member relative to said housing member between a contracted and extended position for a given time during a jarring stroke when the jar is tensioned, said hydraulic means including a chamber which in use is filled with fluid in said housing member with adjoining first and second bores, said first bore having a lesser diameter than said second bore, and a piston on said mandrel member receivable in said first bore, said piston having a slightly smaller diameter than said first bore to restrict the flow of fluid past said piston as it moves relative to said first bore during the jarring stroke until said piston exits from said first bore whereupon said members move rapidly to the relatively extended position so that the hammer delivers a blow to the anvil, the piston being of annular form and being positioned around the mandrel member for movement therealong between first and second axially spaced stops on said mandrel member, said piston having a first end adapted to cooperate with the first stop to permit free flow of the fluid between the piston and mandrel member as aid members move toward the contracted position, and the piston having a further portion adapted to co-operate with said second stop to provide sealing engagement therewith during movement of the piston through the first bore during the jarring stroke, one of said further portion and said second stop including a smooth annular wall portion which is sloped relative to the longitudinal axis of the jar while the other includes a smooth annular surface having a convexly arcuate contour as seen in a longitudinal section, with said annular wall portion and said annular convexly arcuate surface being relatively disposed to come into said sealing engagement during the jarring stroke, and wherein said further portion is located interiorly of said piston intermediate said first end thereof and the end of the piston opposite said first end.

2. The hydraulic jar of claim 1 wherein said further portion of the piston is located nearer to said first end than it is to the opposite end of the piston.

3. The hydraulic jar of claim 2 wherein said sloped wall portion comprises a frustro-conical wall portion.

4. The hydraulic jar of claim 1 wherein said sloped wall portion comprises a frustro-conical wall portion, the latter being located on said annular piston while the annular convexly arcuate surface is located on said mandrel member.

5. The hydraulic jar of claim 2 wherein said sloped wall portion comprises a frustro-conical wall portion, the latter being located on said annular piston while the annular convexly arcuate surface is located on said mandrel member.

6. The hydraulic jar of claim 1 or 2, wherein said convexly arcuate surface has a semi-circular outline as seen in longitudinal section.

7. The hydraulic jar of claim 4 or 5 wherein said convexly arcuate surface has a semi-circular outline as seen in longitudinal section.

8. The hydraulic jar according to any one of claims 1, 2, 4 or 5 wherein said mandrel member has a splined connection with said housing member permitting non-rotative relative movement between said extended and contracted positions.

* * * * *